US006398637B1

(12) United States Patent
Tsuchida

(10) Patent No.: US 6,398,637 B1
(45) Date of Patent: Jun. 4, 2002

(54) HIGH SPEED COIN DISPENSER

(75) Inventor: Tamotsu Tsuchida, Iwatsuki (JP)

(73) Assignee: Asahi Seiko Kabushiki Kaisha (JP)

( * ) Notice: Subject to any disclaimer, the term of this patent is extended or adjusted under 35 U.S.C. 154(b) by 0 days.

(21) Appl. No.: 09/588,517

(22) Filed: Jun. 6, 2000

(30) Foreign Application Priority Data

Jun. 25, 1999 (JP) ..... 11-215696

(51) Int. Cl.[7] ..... G07D 1/00
(52) U.S. Cl. ..... 453/57
(58) Field of Search ..... 453/57, 29, 35, 453/49; 221/241, 254, 258, 277, 280

(56) References Cited

U.S. PATENT DOCUMENTS 1,524,940 A * 2/1925 Matson
5,122,094 A 6/1992 Abe ..... 453/57
5,662,520 A * 9/1997 Evdokimo ..... 453/3
5,816,232 A * 10/1998 Bell ..... 124/51.1
6,193,598 B1 2/2001 Tsuchida ..... 453/57

FOREIGN PATENT DOCUMENTS

EP 0959437 A2 11/1999 ..... G07D/9/00

* cited by examiner

*Primary Examiner*—Donald P. Walsh
*Assistant Examiner*—Mark J Beauchaine
(74) *Attorney, Agent, or Firm*—McGlew and Tuttle, P.C.

(57) ABSTRACT

A device is provided in which the coin size can be simply changed, even if the paid out coin type is changed. The dispensing efficiency of the coins is maintained at a good level, even if the device is operated at high speed. The coin dispensing device includes a tank for storing coins in loose condition and a freely rotatable disk is provided at the bottom in the tank and has an open hole for receiving coins. An adjustment device is arranged on the underside of this disk means for forming the open hole into an adjustment coin size hole. A guide element is arranged on the upper surface of the disk for guiding several coins in the open hole.

7 Claims, 4 Drawing Sheets

HIGH SPEED COIN DISPENSER

FIELD OF THE INVENTION

This invention relates to a coin dispensing equipment storing and issuing a plurality of small disk like coins and more particularly, this invention concerns a high-speed dispensing device storing coins in loose condition for releasing coins one by one at high speed. Further, this invention concerns coin dispensing equipment which can be changed in response to the type of coin, that is to say, in proportion to the coin size. The terminology "coin" used in this specification, of course includes coins which are currency as well as other small disk bodies such as medals and tokens for games. The coin dispensing apparatus of the invention is particularly used in coin changers and game machines.

BACKGROUND OF THE INVENTION

Until now, various types of devices for paying out the coin are known. For example, a coin dispensing equipment is shown in Japanese Patent Application 2-152852 by this applicant. This Japanese Patent Application 2-152852 is published as Japanese Patent Publication 6-44305. The Japanese Patent Application 2-152852 has become U.S. Pat. No. 5,122,094. These publications disclose coin dispensing equipment, which is summarily shown in FIGS. 4A and 4B.

The structure shown in FIG. 4, is summarily explained below, with an explanation of the operation of this equipment.

An electric motor (not shown) in this coin dispensing device is driven such that a center rotating shaft 112 is rotated. When rotating shaft 112, a disk 102 is rotated in an almost standing condition and at the clockwise direction. The disk 102 is a deep plate and is rotated near the base within a large generally pot-shaped tank 101. By this rotation of disk 102, the coins on or in contact with this disk 102 are agitated by an agitation action. The agitation action is generated by protrusions 106 which are formed inside the surrounding wall 104 of this disk 102. Thus, the coins in disk 102 go into coin receiving holes 105 which are opened at the base of this disk 102.

Most of the coins which went into these receiving holes 105 slide on and move on the surface of support-plate 111 by the disk 102. The lowest coins which are slid and moved will be forced out to a coin exit 123. The lowest coin is moved by slender feed nails (not shown) which are formed on the underside of disk 102. The lowest moved coin is guided and sent out to exit 123 by guide plate 115 and a flange surrounding wall 122. The guide plate 115 is formed almost with an oval shape at the surface center of large square support-plate 111.

A flange surrounding wall 122 is formed in a ring shape in order to install a tank 101 on support-plate 111. The coin which is sent out to exit 123 is dispensed from this exit 123. The coin is released from exit 123 by fixation roller 124 and mobile roller 126 with a spring (not shown).

As described above, the conventional coin dispensing equipment included an apparatus for sending out or issuing coins of identical type. Therefore, there was a problem that the conventional coin dispensing equipment could not be simply converted into other size coins.

Further, when the conventional coin dispensing equipment was operated at high speed, problems resulted in that the coin dispensing efficiency became poor. In other words, when the conventional coin dispensing equipment was operated at high speed, the resulting coin pickup efficiency was poor.

SUMMARY AND OBJECTS OF THE INVENTION

A primary object of this invention is to provide a device in which the coin size can be simply changed, even if the paid coin type is changed.

A further object of this invention is to provide a device in which the dispensing efficiency of coin is good, even if operated at high speed. The purpose of improving the coin pickup efficiency at high speed operation is to be obtained by a simple construction or arrangement.

According to the invention a coin dispensing apparatus is provided comprising a tank for storing coins in a loose condition and a freely rotatable disk provided at the bottom in the tank. The disk has an open hole for coins to fall therethrough. An adjustment means or adjustment device is arranged on the underside of this disk for forming the open hole into an adjustment coin size hole. A guide or a guide means is arranged on the upper surface of the disk for guiding several coins in the open hole.

The guide means may be advantageously a guide element of a sea star shape or starfish shape of a given thickness.

The coin dispensing equipment of the invention may be provided with the guide having a plane or surface to which the coin contacts, which is sloped.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
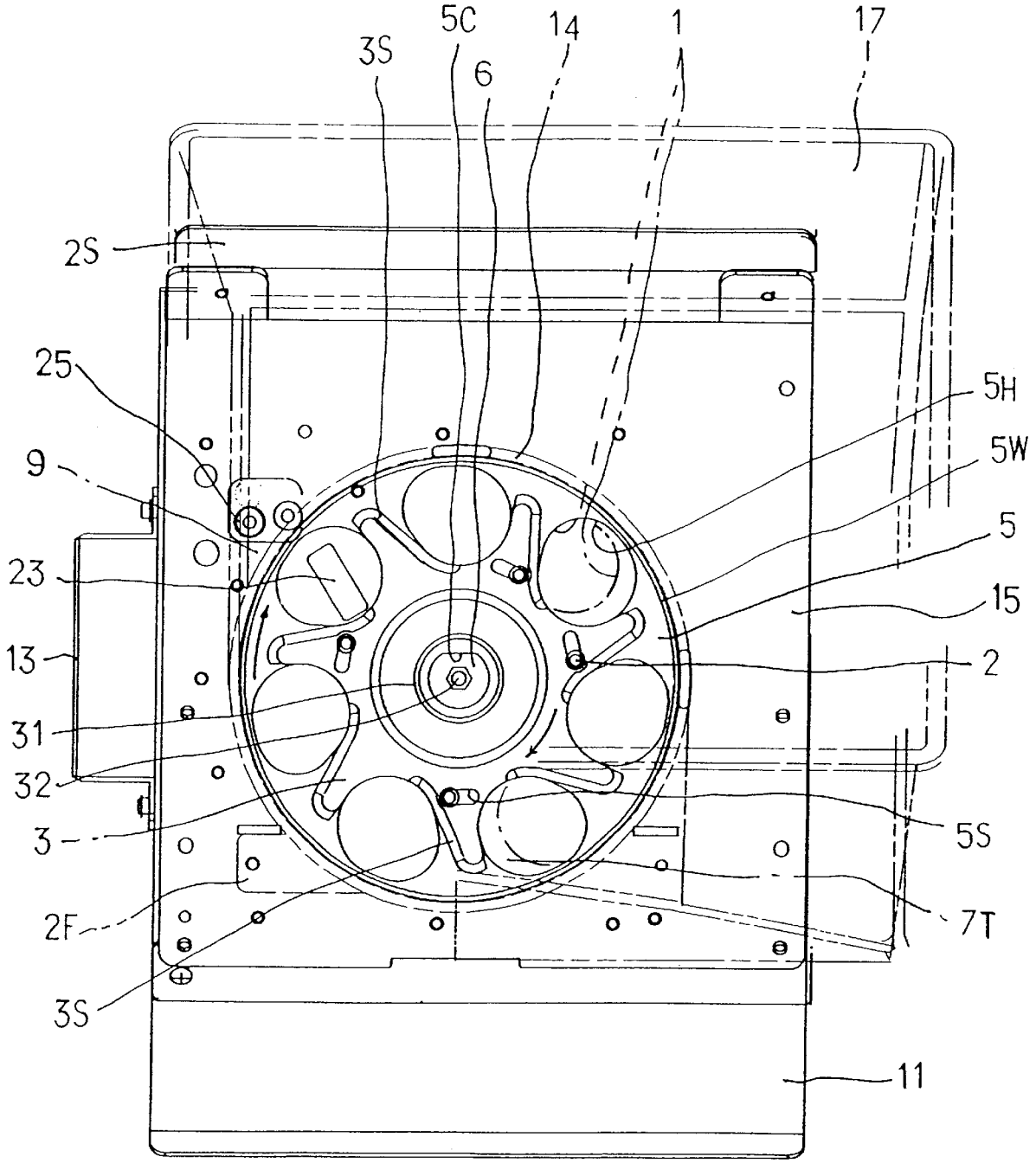
FIG. 1 is a cross-sectional end view in which the front of an embodiment or coin dispensing equipment according to this invention.
Figure 3:
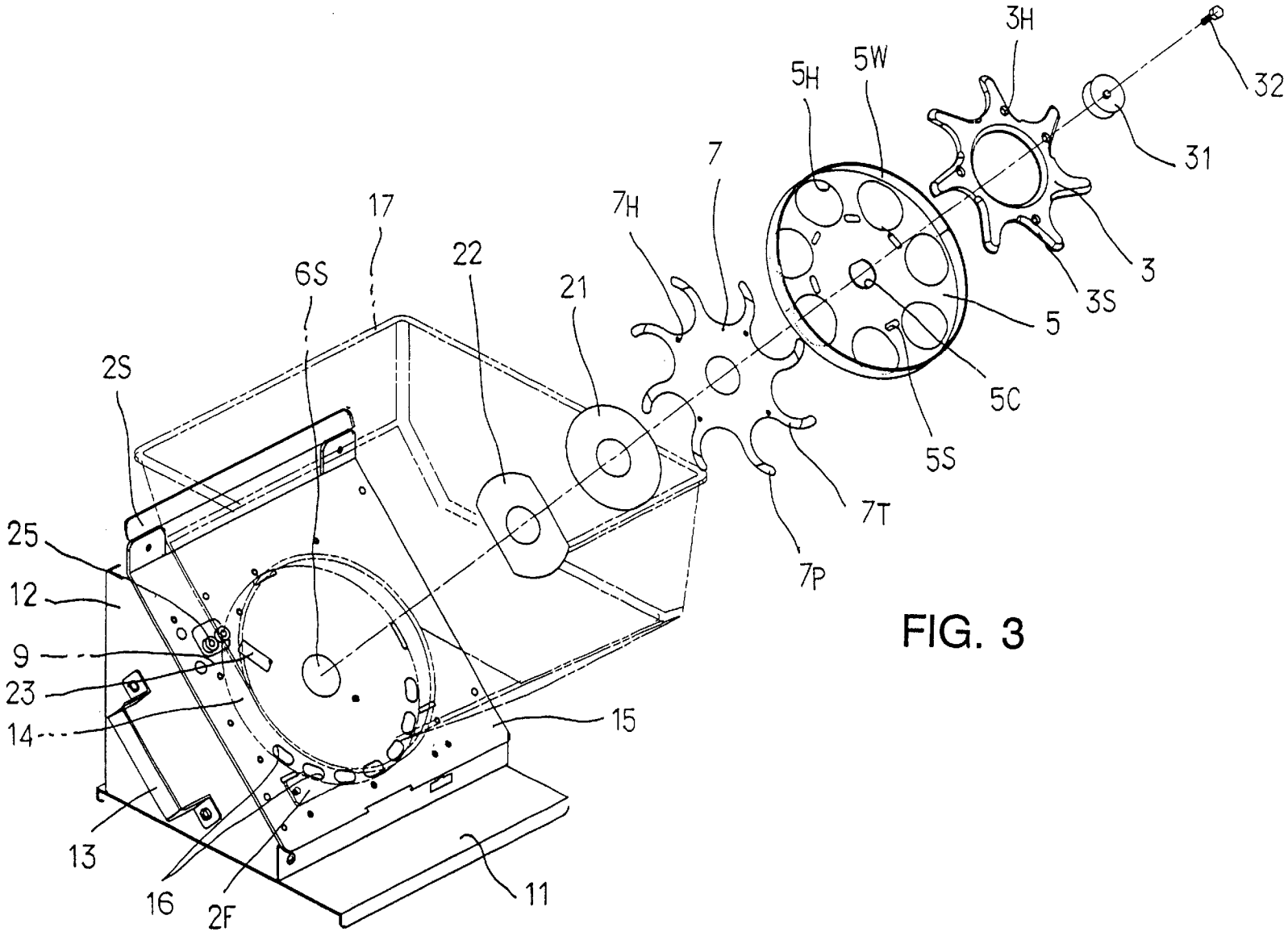
FIG. 3 is a generally exploded perspective view in which the practical example of FIG. 1 is decomposed and shown.
Figure 4A:
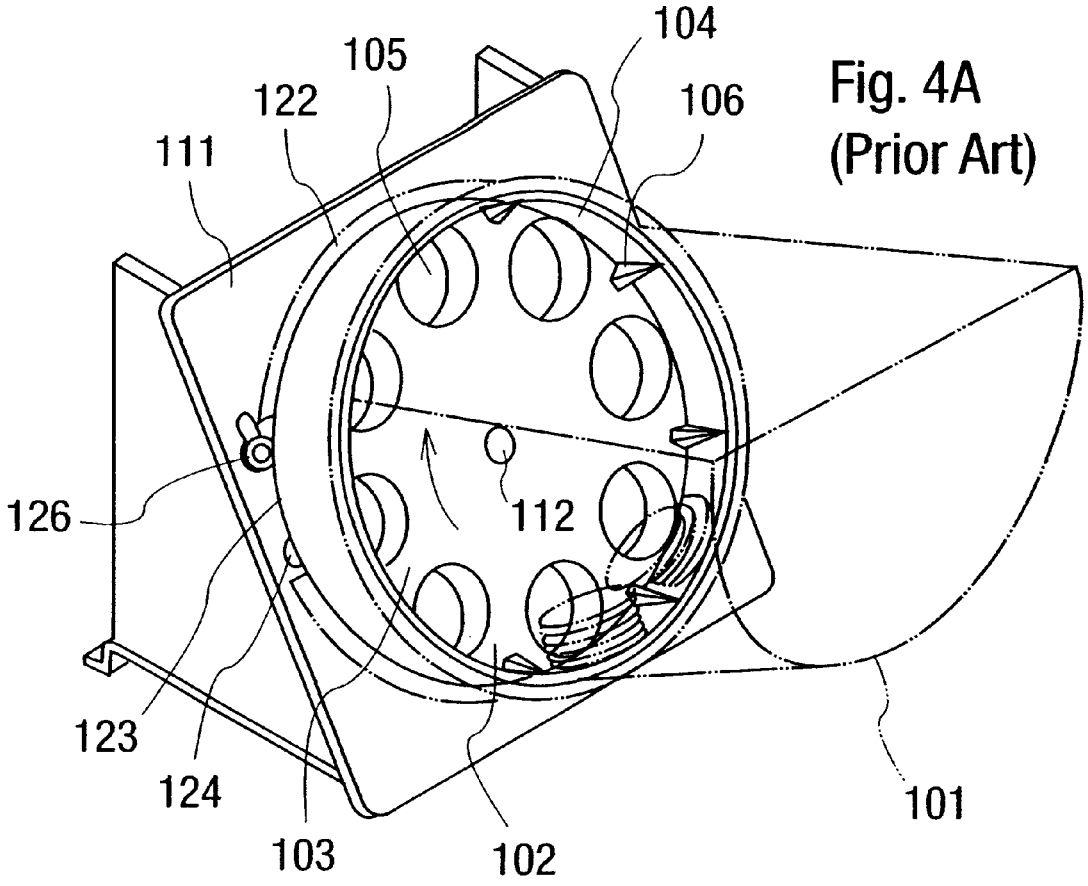
Fig. 4A (Prior Art)
FIG. 4A is a perspective view of a prior art device.
Figure 4B:
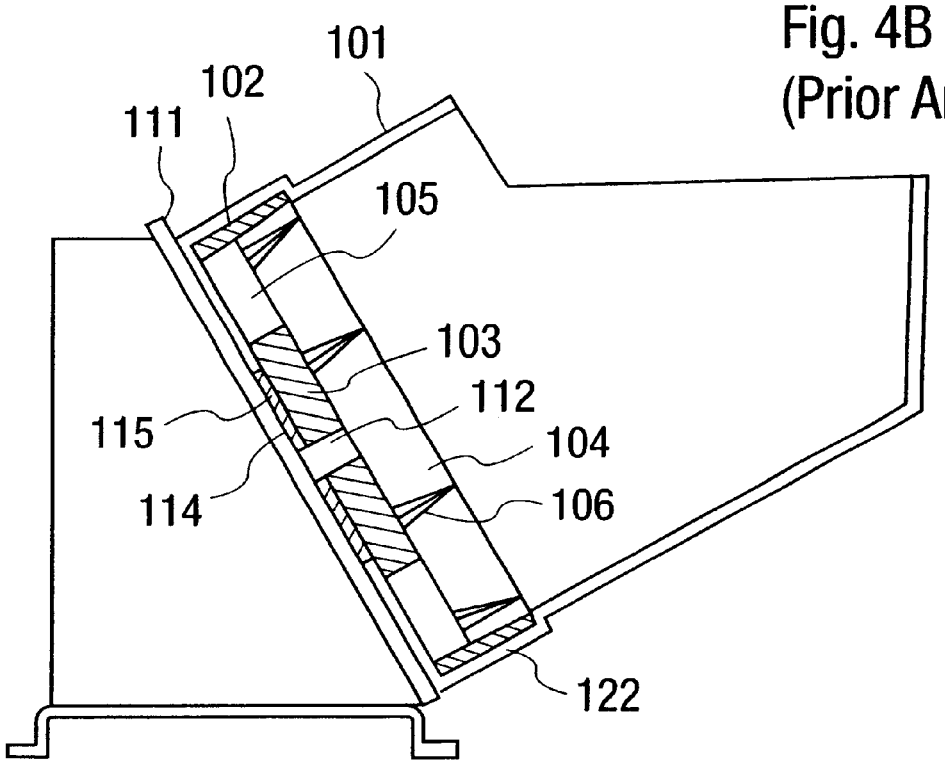
Fig. 4B (Prior Art)
FIG. 4B is a side cross-sectional view of the prior art device.

Referring to the drawings in particular, reference numeral 11 which is shown in FIGS. 1 and 3 designates a mount base of the coin dispensing apparatus. This mount base 11 is a rectangular board with three edges bent downward forming legs of a three point support. On upper right and left surfaces of mount base 11 leg frames 12 are provided with an almost right angled triangle.

A handle 13 is provided for portability installed on one of leg frames 12. A large square base board 15 is installed on the pair of leg frames 12 in a tilted position. At suitable portions of base board 15, several openings are provided. Elongate holes 16 are provided to allow dust or the like to fall through. These several long holes 16 open at the downward division of base board 15 (see FIG. 3). And, on the lower edge portion of base board 15, a slender stationary plate 2F is provided for fixing large tank 17. On the upper edge of base board 15, a slender support plate 2S is provided for retaining tank 17 by hook. Support plate 2S is arranged to be slideable in going up and down and to be fixable.

The tank 17 for coin accommodation is a resin molded article with a large angle pot-shape. The lower portion of tank 17 is formed in a cylinder 14 and is installed at the almost center of base board 15. In the inside of the cylinder 14, which is the bottom portion of tank 17, a disk 5 is arranged to freely rotate.

Figure 2:
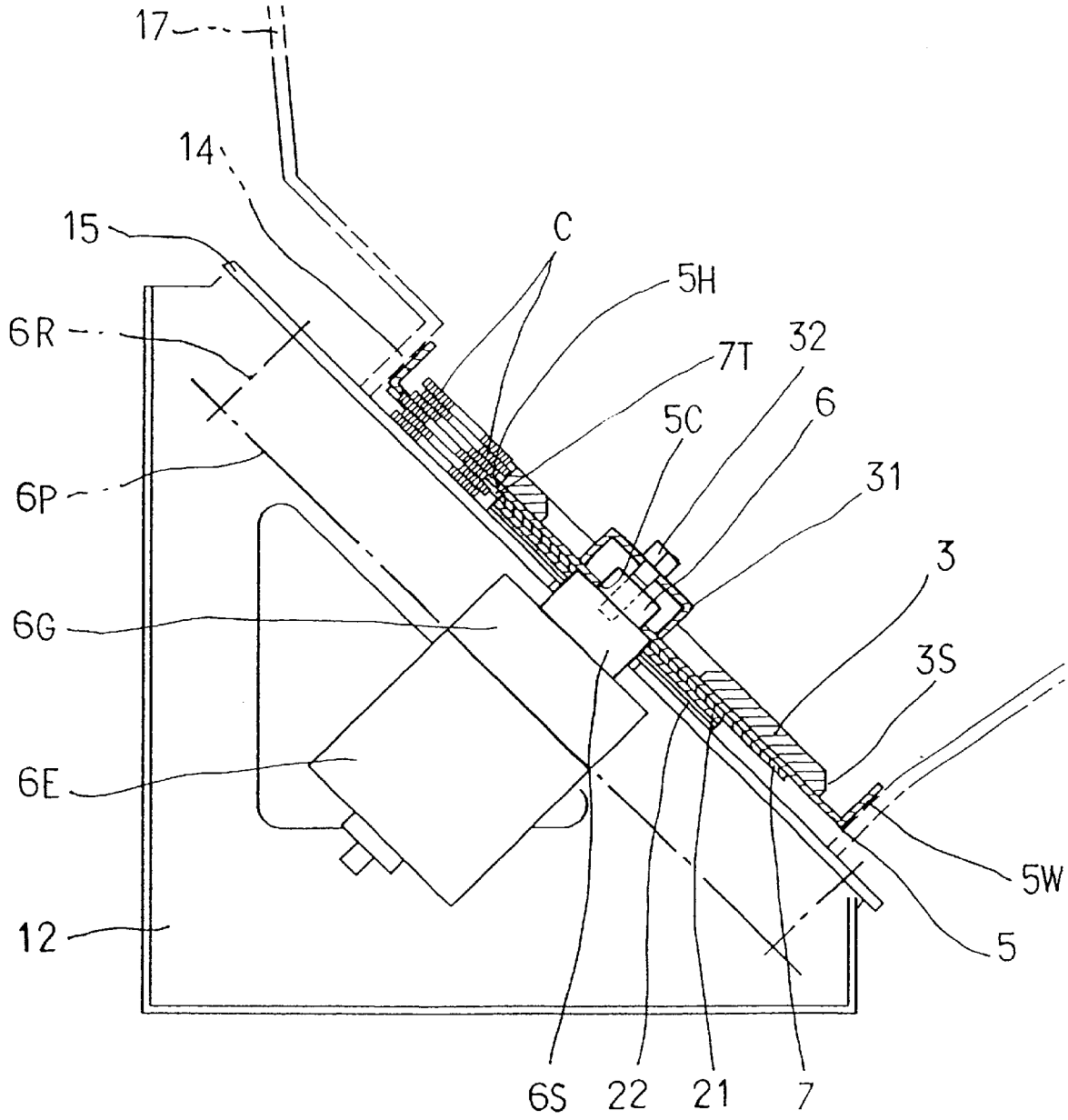
FIG. 2 is a generally enlarged section view showing the apparatus FIG. 1 from the side.

The disk 5 is formed with a deep plate shape, as shown in FIG. 3, namely along the whole surrounding edge of disk 5 a standing wall 5W is formed. Over the whole peripheral part of disk 5 open holes 5H, each for receiving a coin and to form a coin chute are formed at regular-intervals, respectively. This disk 5 is rotated clockwise, as shown in FIG. 1, by a central driving shaft 6. The stepped driving shaft 6 is rotated by an electric motor 6E, with gear device 6G for deceleration (see FIG. 2).

On the upper surface of disk 5, guide body 3 is provided. The guide body 3 is a sea star or star shaped element with a ring shaped central opening. The guide body 3 is installed as shown in FIG. 3. Guide body 3 has a thickness defining faces in the rotation direction. These faces are formed in slope planes 3S. These planes on guide body 3 contact coins upon rotation and are formed in slope planes 3S. Guide body 3 of generally ring shape is installed on disk 5 with screws 2 extending through holes 3H (refer to FIG. 1). On the underside of disk 5, adjustment board 7 of generally gear shape is installed (refer to FIG. 3). Adjustment board 7 is freely rotatably mounted at the center about stage division 6S of driving shaft 6 (refer to FIG. 2). Adjustment board 7 is installed on disk 5 by screws 2 and several screw holes 7H. The tip of screws 2 respectively slide-freely and penetrate into hole 3H of guide body 3. The tip of screws 2 move-freely and penetrate into slender hole 5S of disk 5. By tightening the tips of these screws 2 into screw hole 7H of adjustment board 7, the whole construction is fixed. That is to say, by several screws 2, guide body 3 and disk 5 and adjustment board 7 are fixed together.

With open hole 5H and tooth division 7T of adjustment board 7, adjustment hole 1, which is responded to the size of coin C is formed (refer to FIG. 1). Each tip 7P which is at slender and curved tooth divisions 7T of adjustment board 7 is properly bent a little in the downward direction. Therefor, coin C is surely removed by tip 7P. On underside center of adjustment board 7, a disk like spacer 21 is placed (refer to FIG. 3). Spacer 21 is properly changed in proportion to the thickness of coin C. It is of course preferable that a plurality of spacers 21 are used.

Between spacer 21 and base board 15, an elliptical slide board 22 is placed (refer to FIG. 3). Slide board 22 is an element for smoothing the rotation of disk 5, and a plurality of slide boards 22 may be used. Slide board 22 and spacer 21 and adjustment board 7 are freely rotatably mounted on stage division 6S of driving shaft 6 (refer to FIG. 2). Disk 5 is mounted on driving shaft 6, via center hole 5C. A part of center hole 5C is formed in a straight line, so that disk 5 is rotated by driving shaft 6.

It was noted before that guide body 3 with sea star or star shaped and ring shape was installed on the upper surface of disk 5. That is to say, by screws 2, the guide body 3 and disk 5 and adjustment board 7 are fixed together. Therefore, driving shaft 6 will be located at the center of ring-shaped guide body 3. On this driving shaft 6, cap 31 is placed. Then, with this cap 31, bolt 32 is screwed and fixed at driving shaft 6. Bolt 32 is screwed into driving shaft 6 and cap 31 is pressed and fixed on disk 5.

By cutting a lower edge part of cylinder 14, the exit (not shown) for coins is formed. Also, a coin discharge path which communicates to the exit is formed on the base board 15. On base board 15 near coin emission path 9, guide board 23 for coins is placed. Therefore, it is of course provided that the upper surface of spacer 21 is a little higher than the upper surface of guide board 23. Guides board 23 is a rectangular steel plate which is bent such as in an even L shape. Then, the base end part of guide board 23 is freely transferably mounted on the underside of base board 15 with bolts. The tip end part of guide board 23 is tilted a little and projects from the surface of base board 15 with a hole. A spring (not shown) is covered on the aforesaid bolt. Therefore, this spring presses the guide board 23 at the underside of base board 15. When disk 5 is rotated positively (refer to FIG. 1), guide board 23 guides the coin to the direction of emission path 9 at the standing plane. Also, when disk 5 is reversed, the coin can get over guide board 23 by the function of the slope and spring. Electric motor 6E is fixed by screws (not shown) with the mount board 6P and rod 6R.

With the above-mentioned embodiment, coins C of identical type are stored in tank 17 at bulk condition and electric motor 6E is driven. When electric motor 6E is driven, disk 5 is rotated, as shown in FIG. 1. When disk 5 is rotated, coins C will be guided in open holes 5H by guide body 3 (refers to FIG. 2). In other words, when disk 5 is rotated, several coins C are always piled up at the position of open holes 5H, by guide body 3. In the position of open holes 5H, several coins C are always stored, and the coin dispensing is not broken off such as described later. Therefore, even if the coin is paid or fed at high speed, the paid out coin stream is not broken off, since a plurality of coins C are at the position of open holes 5H.

Although guide body 3 is formed like a sea star shape in this practical example, it is of course also good to form it with a windmill shape for example. When the number of open holes 5H is three, it is of course possible to use a Y-shaped guide body. Further, it is of course possible for each small ring guide body to be individually installed on each open hole 5H.

Thus, when coin C is smaller than adjustment hole 1 which is formed by tooth division 7T and edge of hole 5H, coin C rides on the upper surface of base board 15. The coin C which so rides on the upper surface of base board 15 is then slid and moved by tooth division 7T of adjustment board 7 fixed on the rotated disk 5. The adjustment board 7 acts as a scraper for coin C. The sliding and moving coin C is guided by cylinder 14 of tank 17. Guided coin C is sent out from the opened exit (not shown) of cylinder to emission path 9. Of course coins larger than the adjustment hole 1 are not sent out to emission path 9. Even if a large coin is mixed in fixed size coins, this large coin is not discharged from this apparatus. Coin C which is sent out to emission path 9 operates counting roller 25, resisting the spring (not shown).

The transfer for this counting roller 25 is detected by a sensor (not shown). Hereupon, in this practical example, a case in which the size of coin is changed is described.

When small coins are chosen, tooth divisions 7T of adjustment board 7 are moved a little in the counterclockwise direction, in FIG. 1. By loosening four screws 2, adjustment board 7 is rotated a little in the counterclockwise direction, and then the board 7 is fixed by screws 2 on disk 5 again.

In the practical example, though disk 5 is tilted, it is of course acceptable for disk 5 to be leveled. In other words, this practical example is a type of devices which releases the coin in the standing condition almost. Therefore, this invention can be of course applied to a type of equipment which releases the coin in a level condition. Although disk 5 in the drawing has standing wall 5W, it is of course acceptable that there may be no standing wall 5W. In addition, it is of course possible for disk 5 to be formed such as a thick disk. In this case, guide body 3 will be formed integrally on disk 5. Also, it is of course possible that the size of open hole 5H is determined by considering the largest size of applied coins.

Although adjustment board 7 in this practical example is formed like a generally gear type, it is of course possible to form board 7 as a circular saw type element. For example, when the number of open holes 5H is three, a triangle shaped adjustment board may be used.

It is also possible that each adjustment board of tooth division 7T only is individually installed on each open hole 5H.

As described above, by the use of a simple construction, according to the invention, one coin dispensing apparatus can be simply applied to various coin sizes. The equipment sends out coins of identical type one by one and is able to be simply converted for coins of other sizes. Further, this invention adds a simple guide body which superimposes several coins on the upper surface of disk for coin dispensing. Several coins will be always piled up at the position of open hole awaiting a coin falling. Therefore, according to this invention, even if the coins are paid out at high speed, several coins are in the open hole, and therefore the coin dispensing will be not broken off.

While specific embodiments of the invention have been shown and described in detail to illustrate the application of the principles of the invention, it will be understood that the invention may be embodied otherwise without departing from such principles.

What is claimed is:

1. A coin dispensing apparatus comprising:

a tank for storing coins in a loose condition;

a freely rotatable disk provided at the bottom in the tank, the disk having an open hole for coins falling therethrough;

an adjustment device arranged on an underside of said disk for forming said open hole into an adjustment coin size hole; and a guide arranged on an upper surface of said disk for guiding several coins into the open hole.

2. A coin dispensing apparatus according to claim 1, wherein said guide has a sea star shape with a predefined thickness.

3. A coin dispensing apparatus according to claim 1, wherein said guide has a coin contact plane with a sloped surface.

4. A coin dispensing apparatus, comprising:

a tank for storing coins in a loose condition;

a freely rotatable disk provided at the bottom in the tank, the disk having an open hole for coins falling therethrough;

adjustment means arranged on an underside of said disk for forming said open hole into an adjusted coin size hole; and guide means arranged on an upper surface of said disk for guiding several coins into the open hole.

5. A coin dispensing apparatus according to claim 4, wherein said guide means is a guide element having a starfish shape with a predefined thickness.

6. A coin dispensing apparatus according to claim 4, wherein said guide has a coin contact plane with a sloped surface.

7. A coin dispensing apparatus, comprising:

a tank for storing coins in a loose condition;

a freely rotatable disk provided at the bottom in the tank, the disk having an open hole for coins falling therethrough;

an adjustment device with and adjustment element arranged on an underside of said disk for forming said open hole into an adjusted coin size hole; and a guide element arranged on an upper surface of said disk for guiding several coins into the open hole.

* * * * *